US007325338B2

(12) United States Patent
Adler

(10) Patent No.: US 7,325,338 B2
(45) Date of Patent: Feb. 5, 2008

(54) ENGULFMENT RESCUE DEVICE AND METHOD

(76) Inventor: David R. Adler, 1956 Templar, Naperville, IL (US) 60565

( * ) Notice: Subject to any disclaimer, the term of this patent is extended or adjusted under 35 U.S.C. 154(b) by 496 days.

(21) Appl. No.: 11/062,643

(22) Filed: Feb. 22, 2005

(65) Prior Publication Data

US 2005/0144813 A1 Jul. 7, 2005

Related U.S. Application Data

(62) Division of application No. 10/394,957, filed on Mar. 21, 2003, now Pat. No. 6,857,207.

(51) Int. Cl.
*E02F 1/00* (2006.01)

(52) U.S. Cl. ..... 37/466; 37/905

(58) Field of Classification Search ..... 37/195, 37/466, 905, 317–336, 342–344
See application file for complete search history.

(56) References Cited

U.S. PATENT DOCUMENTS 4,936,031 A * 6/1990 Briggs et al. ..... 37/347
4,991,321 A * 2/1991 Artzberger ..... 37/309
4,998,282 A * 3/1991 Shishido et al. ..... 381/77
5,140,759 A * 8/1992 Artzberger ..... 37/347
5,212,891 A * 5/1993 Schuermann et al. ..... 37/323
5,487,229 A * 1/1996 Nathenson et al. ..... 37/347
5,782,414 A * 7/1998 Nathenson ..... 239/589
5,860,232 A * 1/1999 Nathenson et al. ..... 37/466
5,901,478 A * 5/1999 Sawyer, Jr. ..... 37/323
6,000,151 A * 12/1999 Hayes ..... 37/323
6,470,605 B1 * 10/2002 Gilman et al. ..... 37/323
6,484,422 B1 * 11/2002 Bain et al. ..... 37/323

* cited by examiner

*Primary Examiner*—Christopher J. Novosad
(74) *Attorney, Agent, or Firm*—Ryndak & Suri LLP

(57) ABSTRACT

A device and method is provided for rescuing a person trapped in engulfing material at an engulfment site. A reduction tool is used to loosen the engulfing material in order to free or facilitate freeing a buried or partially buried victim. The loosened engulfing material is subsequently removed from the engulfment site by vacuum excavation. Shoring equipment may be used to stabilize the excavation site prior to commencement of soil reduction and soil removal procedures. The excavation site may include a sump area to receive loosened engulfing material discharged by the reduction tool from the excavation site. The loosened engulfing material in the sump area may also be removed with vacuum excavation techniques.

8 Claims, 4 Drawing Sheets

ENGULFMENT RESCUE DEVICE AND METHOD

CROSS-REFERENCE TO RELATED APPLICATIONS

This application is a divisional application of U.S. patent application Ser. No. 10/394,957, now U.S. Pat. No. 6,857,207 filed Mar. 21, 2003.

FIELD OF THE INVENTION

This invention relates to a device and method for rescuing a person trapped in engulfing material, and more particularly, to a method and device that initially loosens the engulfing material with a reduction tool and removes the loosened engulfing material by vacuum excavation.

BACKGROUND OF THE INVENTION

The rescue of a buried victim is one of the most perilous tasks confronting emergency response personnel. As many as 65% of all deaths from engulfment accidents are the result of rescuers who themselves have been buried and perished in the course of rescue operations. Trench collapses are particularly dangerous, time-consuming, labor-intensive and technically demanding. Since a single cubic foot of soil can weigh as much as 145 pounds it is often necessary to completely expose the victim before it is possible to free or remove the victim from the engulfment site.

To further complicate matters, the rescue of a buried victim is often a race against time. The longer the victim is buried, the greater the likelihood the victim will suffer or die from crush syndrome, internal traumatic injuries, hypothermia or suffocation. Thus, rescuers face the dilemma whether to proceed slowly and cautiously for their own safety or quickly in the hope of saving a victim's life.

Manual excavation techniques, such as the use of hands, shovels and picks do little to resolve this dilemma. Manual excavation is excessively time-consuming even in situations where the location of the buried victim is known at the onset of rescue operations. In addition, manual techniques quickly fatigue rescue workers diminishing their alertness and subjecting them to the risk of a subsequent collapse as the result of careless conduct.

Hydraulic excavation equipment, such as a backhoe, is capable of excavating a large amount of engulfing material very quickly. This type of equipment, however, poses far too great a safety risk to both the victim and rescue personnel to be practically applied to rescue operations. A backhoe can easily crush or otherwise seriously injure or mutilate a buried victim without the operator knowing it. The weight of such equipment on the area surrounding the excavation site also causes deleterious vibrations and imposes extra loads on the surrounding areas of the already unstable engulfment site creating risk of further ground collapse and entrapment of rescue personnel.

A need therefore exists for an effective rescue technique for rescuing a victim entrapped in engulfment material. A need further exists for a trench rescue device and method that minimizes the hazards to rescuers working at the engulfment site.

SUMMARY OF THE INVENTION

In accordance with the present invention, a method and device are provided for rescuing a person entrapped in engulfment material at an engulfment site. As used herein, the term "rescue" includes freeing a buried person entrapped in engulfing material as well as the retrieval of the body of a victim who unfortunately perished as a result of being buried in engulfing material. As used herein, "engulfing material" may be any type of particulate solid or substantially solid material capable of trapping or burying a person. Typically, engulfment material may include any type of soil including, dirt, clay, sand, stone and combinations thereof as well as other materials such as, for example, grain, fertilizer, salt, and other particulates. Thus, the term "engulfment site" designates the general entrapment location of the victim by the engulfing material. The engulfment site may be above ground, below ground or may have areas both above and below ground.

The method includes loosening the engulfing material with a stream of air, which typically is a stream of compressed air, and vacuum conveying the loosened engulfing material from the engulfment site to a remote location. The loosening and conveying of the engulfing material is continued at least until sufficient engulfing material is removed to facilitate the rescue or removal of the person from the engulfment, and typically will continue until the pressure on the buried person's chest is at least partially reduced, and may continue until the person is subsequently removed from the engulfment site. The loosening and conveying of the engulfing material may continue until a buried portion or portions of the person is or are at least partially exposed. Upon such exposure, the loosening and conveying may continue until the victim is at least partially exposed. The loosening and conveying may continue to an extent sufficient to extract the victim from the engulfment site. Alternatively, manual excavation techniques may be used once sufficient material is removed in accordance with the invention or buried portion or portions of the victim are partially exposed.

In one embodiment, typically the method includes initially identifying the general location of the buried person. The engulfing material is then loosened by a first operator directing a high velocity air stream, typically a stream of compressed air from a soil reduction tool, which can be a hand-held soil reduction tool on the area to be excavated. A vacuum hose having a hose inlet is used to remove the loosened engulfing material from the excavation site. A second operator positions the vacuum hose inlet above the area to be excavated, and moves the vacuum hose inlet in a generally horizontal manner to excavate an area larger than the diameter of the hose inlet. The second operator continues thereby forming an area large enough to permit or facilitate removal of the buried person.

The method may also provide a vacuum safety device or a shutoff for reducing or eliminating the vacuum force at the vacuum hose inlet. The safety device is manually actuated by a third operator observing and overseeing the rescue operation. In the event the third operator observes or identifies the location of the victim or otherwise determines it is necessary to cease rescue operations the third operator may actuate the switch to shut off the vacuum. The third operator may control a shutoff for the reduction tool in a similar manner. The method may also include either one of the first two operators communicating to the third operator through the use of hand signals to signal the third operator to manually actuate or deactuate either one or both of these safety devices and/or the reduction tool and/or the vacuum conveying device.

In one embodiment, the method includes identifying the general location of the buried person and shoring at least a portion of the engulfment site. Shoring stabilizes the area to be excavated and reduces the risk of further engulfment by the victim and/or rescue personnel. Preferably, the engulfment site is at least partially shored prior to commencement of the soil reduction and soil removal procedures. The method may further include creating a sump area horizontally spaced from the victim. Preferably, the sump area is located horizontally in front of the victim's face and chest. The method may further include operating the reduction tool to direct the loosened engulfing material into the sump area and to loosen material in the sump area. The vacuum hose inlet is positioned in the sump area, typically above the material to be removed, and is used to vacuum convey the loosened material from the sump area, typically to a remote location. A second sump area may be created at a second position further horizontally spaced from the victim relative to the first sump area. Flowable material, i.e., water, present at the excavation site may be collected in, and removed from, the second sump area. Removal may be accomplished by the vacuum hose or a second vacuum hose, the inlet of which is positioned over the second sump area to remove the flowable material therefrom.

In accordance with another aspect of the present invention, a device and/or rescue kit is provided for rescuing a person trapped in engulfing material comprising a vacuum hose having a hose inlet, a vacuum source in communication with the vacuum hose and hose inlet, a reduction tool in communication with a compressed air supply, a manually actuable safety device for reducing the vacuum force at the vacuum hose inlet and/or terminating the pressurized fluid supply to the reduction tool, and shoring equipment. The soil reduction tool is suitable for directing a stream of compressed air onto areas of engulfing material to loosen or otherwise break up the engulfing material into smaller pieces. The reduction tool may be independent from or otherwise unattached to the vacuum hose inlet. Alternatively, the soil reduction tool may be integral to the vacuum hose. By positioning the vacuum hose inlet a distance above the loosened engulfing material, the vacuum hose and hose inlet, in conjunction with the vacuum source, vacuum convey the engulfing material away from the engulfment site. The vacuum hose inlet may further include a safety tip composed of a flexible boot. The shoring equipment typically includes shoring members and hydraulic and/or pneumatic shoring supports.

In an alternate embodiment of the present invention, an emergency rescue kit is provided for rescuing a person trapped in engulfing material at an engulfment site. The kit includes a vacuum system and a reduction system contained on a single movable wheeled device. The vacuum system includes a vacuum hose having an inlet, the vacuum hose connected to a vacuum source by a vacuum line. The reduction system includes a soil reduction tool connected to a pressurized air supply by a compressed air line. The kit provides a sufficient amount of vacuum line and compression line so that the wheeled vehicle may be deployed a safe distance from the engulfment site, preferably at least 30 feet away from the engulfment site. The kit also includes shoring equipment including shoring members and shoring supports. The shoring supports are preferably hydraulically or pneumatically adjustable.

DETAILED DESCRIPTION OF THE PREFERRED EMBODIMENTS

1. Rescue Equipment

Figure 1:
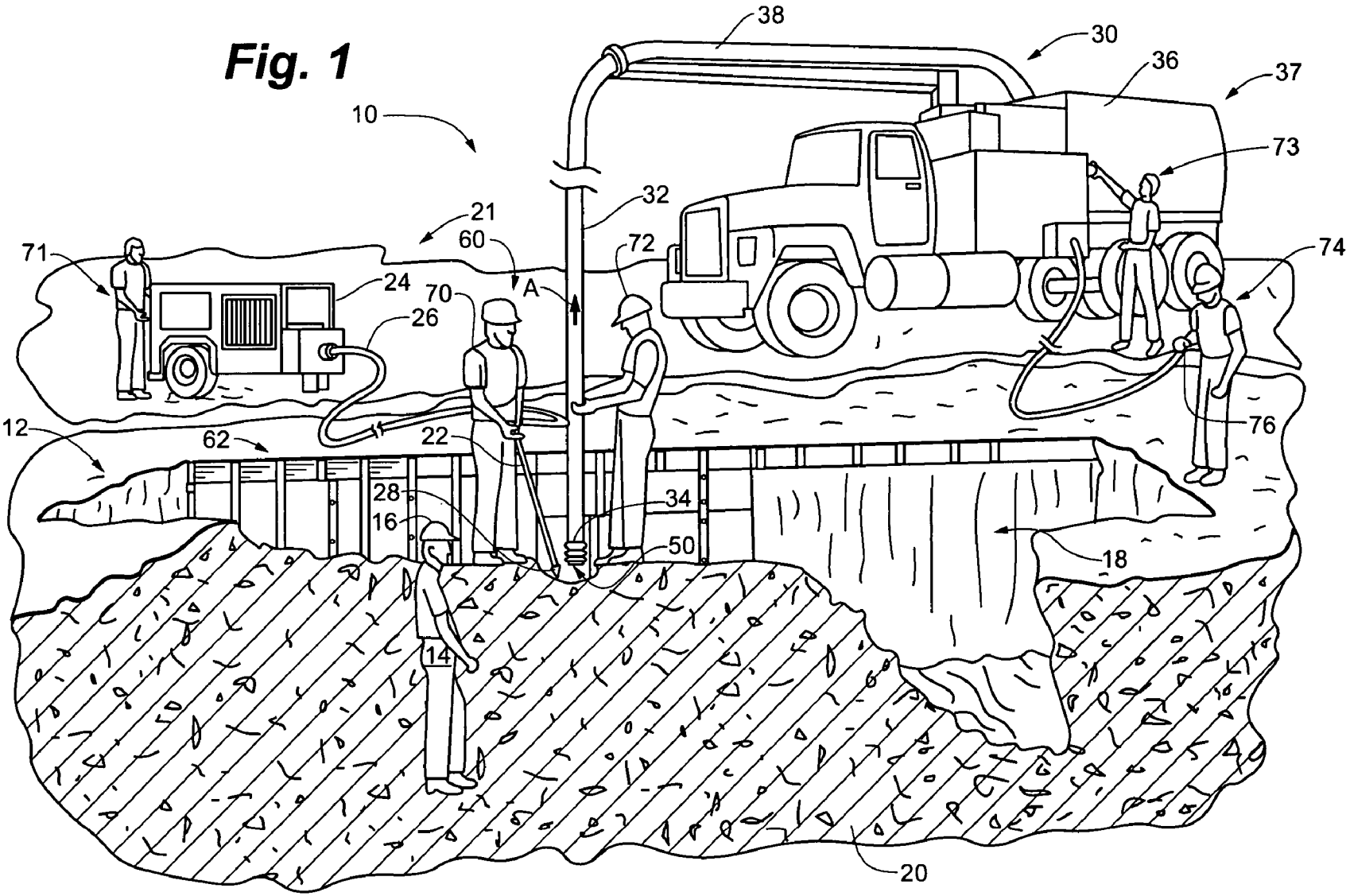
FIG. 1 is a fragmentary perspective view, partly in section, of an engulfment site in accordance with the present invention.

Referring to the FIGURES generally, where like reference numerals denote like structure and elements, and in particular to FIG. 1 which depicts emergency rescue equipment 10 in operation during a rescue-in-progress at an engulfment site 12 to rescue a victim 14 who is trapped, i.e., buried or partially buried by engulfing material 20, which may be in a pit or excavation 18. Pit 18 may be any natural opening in the earth's surface such as a chasm, crevasse or ravine, for example. Pit 18 may also include any man-made opening in the earth's surface including such non-limiting examples as a trench or an excavation. Alternatively, the engulfment site may not include a pit or excavation as the engulfment site, may be either above ground or below ground or may be both partially above and partially below ground.

An engulfment site may be any site or area wherein a victim is buried or trapped by material. Consequently, an engulfment site typically occurs as a result of accidents, other mishaps or acts of God such as earthquakes, floods, mudslides, or avalanches. Other non-limiting situations which may create an engulfment site include the collapse of earth surrounding a subterranean work area such as a trench used to install or repair underground utility lines, a construction site accident entailing collapsed earth and construction materials, a cave-in of a shallow mine or mine entrance, a grain elevator accident or other agricultural mishap, a truck, rail or manufacturing plant spill which suddenly releases a large amount of material, such as particulate material, for example.

Consequently, generally engulfing material 20 may be nearly any type of material and typically will be a material or materials that can be vacuum conveyed after reduction by a soil reduction tool, and may include liquid and mixtures thereof. Examples of engulfing material 20 include but are not limited to any earth or soil combination of dirt, clay, sand, gravel and stone. Engulfing material 20 may also further include mud, water, sewage, snow, ice, and commercial or agricultural materials such as sand, gravel, salt, grain, fertilizer and feed, for example. The present invention can be applicable to situations wherein a victim is entrapped in a small space, a well or piping for example, and excavation of the earth surrounding the space is necessary in order to extract the victim.

Victim 14 may include any person or persons buried or entrapped in engulfing material 20. It is understood that victim 14 may be in any position when buried in the engulfing material 20. The victim may be in a generally prone position either face up, face down, or lying sideways. The victim may also be curled up or bent over. The victim may even be in a generally inverted position with the head lower than the rest of the body, due to a fall into pit 18 the result due to a sudden collapse of earth of surrounding pit 18, for example. Victim 14 may be completely buried or partially exposed. FIG. 1 depicts an example scenario for rescuers arriving upon engulfment site 12 where exposed head 16 of victim 14 identifies essentially the exact location of the victim in engulfing material 20. However, many earth collapse accidents completely engulf and bury the victim yielding an engulfment site with no indication of the victim's location within the engulfing material. The victim hopefully remains alive in such situations but may be the deceased body of a person who unfortunately perished as a result of being buried in engulfing material 20. Victim 14 may be an adult or child and may also be an animal such as a pet or livestock, for example.

Emergency rescue equipment 10 includes a reduction system 21 having a reduction tool 22 which is connected to a pressurized air supply 24, typically a compressed air supply, by a compressed air line 26. Reduction tool 22 can discharge a high velocity air, typically through an opening or a nozzle 28 to thereby cause loosening, aerating or otherwise reducing engulfing material 20 to facilitate subsequent vacuum removal and conveying thereof. Equipment 10 further includes a vacuum system 30 including a vacuum hose 32 having a hose inlet 34. Vacuum hose 32 is operatively connected to a vacuum source 36 by a vacuum line 38. Hose inlet 34 is directed over the loosened engulfing material thereby vacuum conveying the loosened material through hose inlet 34 through hose 32 and away from engulfment site 12. Emergency rescue equipment 10 is preferably operated by trained rescuers, a description of which follows.

Figure 2:
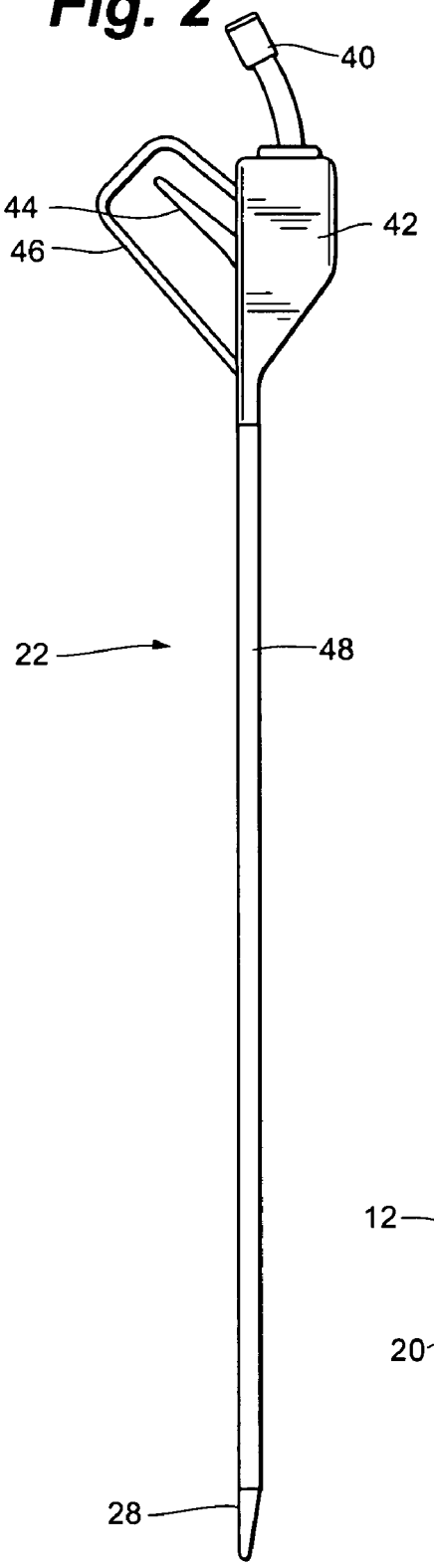
FIG. 2 is a side elevation view of a reduction tool.

Turning to FIG. 2, reduction tool 22 is a hand-held tool and includes a compressed air line connector 40, which may be a "quick-connect" type coupling, that connects to compressed air line 26. Reduction tool 22 also may include, as is typical for such devices, a handle 42, a trigger 44, a trigger guard 46, an elongated tubular member 48 and nozzle 28. Nozzle 28 can be replaceable and enables a rescuer to tailor the reduction tool to the rescue scenario and utilize the most advantageous compressed air discharge rate for the situation. Other possible adaptations to reduction tool 22 include the use of angled nozzles as well as reducers or extenders for elongated tubular member 48. Typical capabilities for reduction tool 22 include an air discharge velocity of about 1200 mph and 150 cubic feet per minute of compressed air at 90 pounds per square inch.

In one embodiment, the vacuum system may include a relatively lightweight device that utilizes an air compressor as the vacuum source that includes a vacuum hose inlet that is hand-held. The device may have, for example, about a 265-cfm or greater rating and preferably includes a highly maneuverable 3-inch diameter hose. Alternatively, the vacuum system may be adapted more for directional boring with a vacuum source having a 500-800 cfm rating and preferably includes a highly maneuverable 3-4 inch hose.

Figure 3:
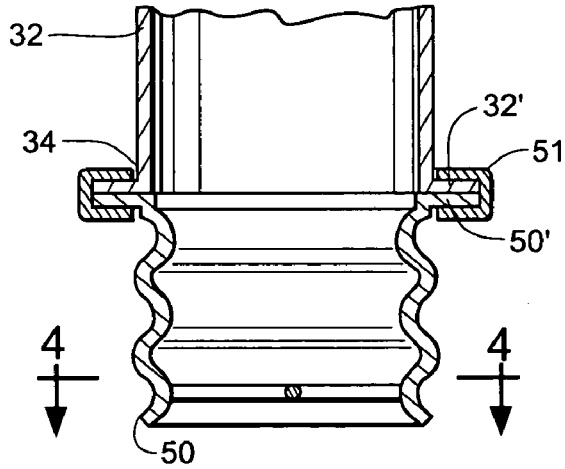
FIG. 3 is fragmentary elevation view of one embodiment of a vacuum hose having a hose inlet and boot.

Most preferred for most rescues to be made in accordance with the invention is vacuum system 30 as shown in FIG. 1 wherein vacuum source 36 is a municipal-type vacuum tank truck 37 having a 2600-8000 cfm-rating. Vacuum hose 32 is preferably about 8 inches in diameter with hose inlet 34 preferably having a flexible boot 50 attached at the end of vacuum hose 32 as shown in FIGS. 1 and 3-5. Attachment may be accomplished by any suitable structure, such as via a clamp 51 that secures hose flange 32' to boot flange 50' as shown in FIG. 3. Boot 50 possesses sufficient rigidity to maintain its substantially circular cross-sectional shape and does not collapse or otherwise bend significantly inwardly during operation and as air and/or engulfing material 20 is conveyed therethrough and into hose inlet 34. Boot 50 is preferably made of a relatively flexible and resilient material such as rubber or a polymer material, for example. Boot 50 provides hose inlet 34 with a vacuum safety tip. Due to its relative flexibility, boot 50 is likely to inflict little or no injury in the event boot 50 inadvertently contacts the victim or a rescuer.

Figure 4:
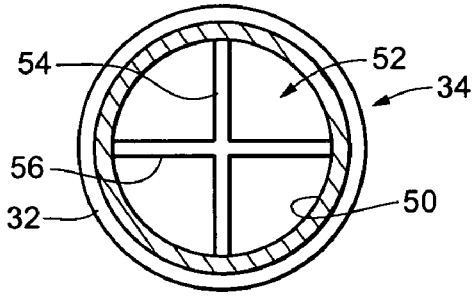
FIG. 4 is a sectional view taken along line 4-4 of FIG. 3.

Hose inlet 34 has an opening 52 as shown in FIG. 4. Optional cross bars 54 and 56 cross the diameter of opening 52 and can provide some rigidity to hose inlet 34. Cross bars 54 and 56 also can provide a safety feature by helping to prevent a significant portion of a person from being sucked into hose 32 as a result of the exceptional suction and high airflow capabilities of vacuum system 30. Other safety features can be utilized which may be known to those skilled in the art of vacuum conveyance devices, for example.

While not preferred, because maneuverability is limited, for example, the reduction tool and vacuum hose may be attached as a single piece of equipment. Such combination may have an elongated tubular member similar to elongated tubular member 48 but with a wider diameter similar to the diameter of hose 32. The excavating end of this elongated member has a nozzle or a plurality of nozzles for discharging high velocity air to loosen soil.

Rescue Procedures

Upon arriving at engulfment site 12, rescuers establish a dig sector 60, which is the area to excavate in order to free the victim. In establishing dig sector 60, rescuers evaluate such factors as location of the victim (if known) or the general location of the victim, the stability of engulfment site 12 and surrounding areas, shoring procedures, the safest area to excavate, delegation of duties, and position of rescue equipment. Heavy equipment such as truck 37 and pressurized air supply 24 are maintained a safe distance from engulfment site 12, preferably at least 30 feet from engulfment site 12, although the distance will, of course, depend on the particular site conditions and preferably not adjacent the longitudinal axis of the trench. Compressed air line 26 and vacuum line 38 are suitably long enough so that the heavy equipment such as pressurized air supply 24 and vacuum truck 37 can be maintained a safe distance away from engulfment site 12. This reduces the chance that the heavier equipment will impart destabilizing loads onto the edges or rims of pit 18 risking further collapse of pit 18. In addition, maintaining heavy equipment away from engulfment site 12 reduces or substantially eliminates the creation of deleterious vibrations, which may also cause a subsequent collapse.

Upon surveying engulfment site 12, arriving rescuers determine the general location of any victims 14, in engulfing material 20. Ideally, exposure of part of victim 14, or the surface contour of engulfment site 12 will reveal the exact location of victim 14. FIGS. 1 and 5-8 and 9-10 illustrate first and second optimal scenarios wherein head 16 of victim 14 is completely exposed or not buried or engulfed. In the event engulfing material conceals the location of victim 14, the rescue crew determines a location of victim 14 as precisely as possible. Shoring equipment 62 is then installed along at least a portion of dig sector 60 as determined by the circumstances at engulfment site 12. Preferably, dig sector 60 is stabilized before any soil reduction and/or vacuum excavation procedures are initiated. Typically, ground pads, which may be plywood sheets, may be laid on the ground adjacent the engulfment or excavation site to help prevent further cave-ins. When it is determined by the rescue crew that shoring is not necessary, or not initially necessary, reduction and excavation procedures may proceed without shoring equipment or until shoring is needed as shown in FIGS. 1 and 5-8, for example. Shoring equipment 62 is typically installed along at least a portion of the perimeter of dig sector 60 to stabilize dig sector 60 from further collapse.

Figure 8:
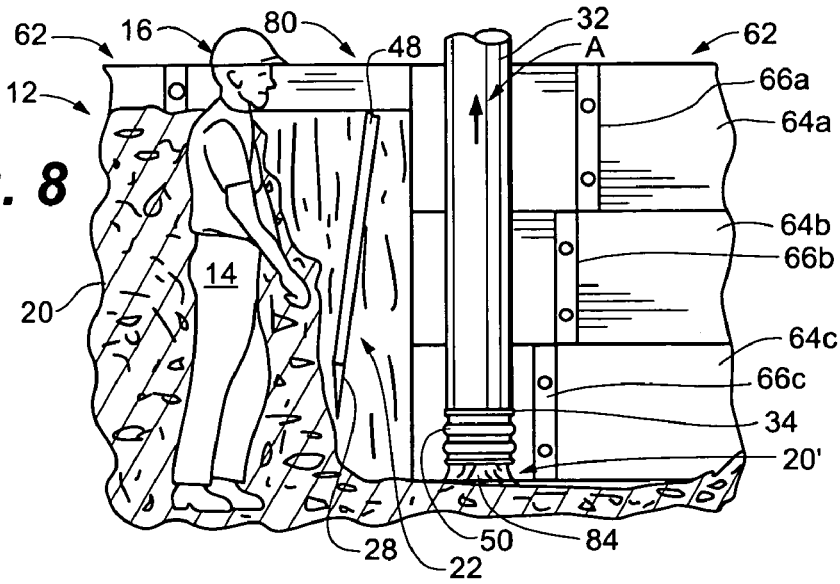
FIG. 8 is a fragmentary perspective view, partly in section, illustrating the continued operation of rescuing a buried victim.
Figure 9:
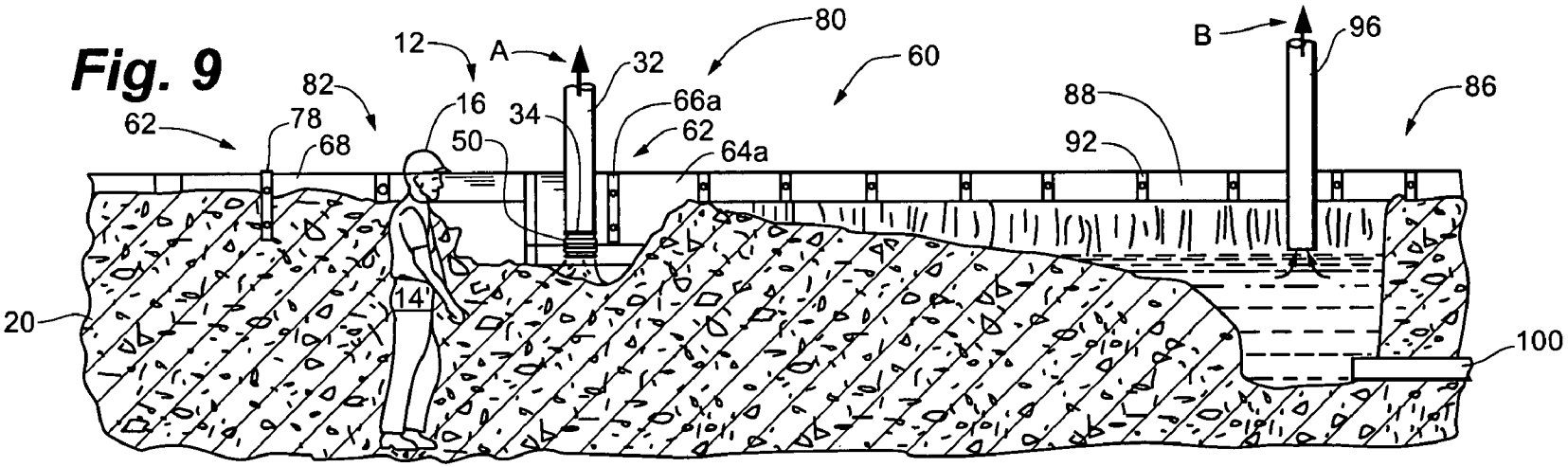
FIG. 9 is a fragmentary view, partly in section, illustrating the operation of rescuing a buried victim at an engulfment site in accordance with an alternate embodiment of the present invention.
Figure 10:
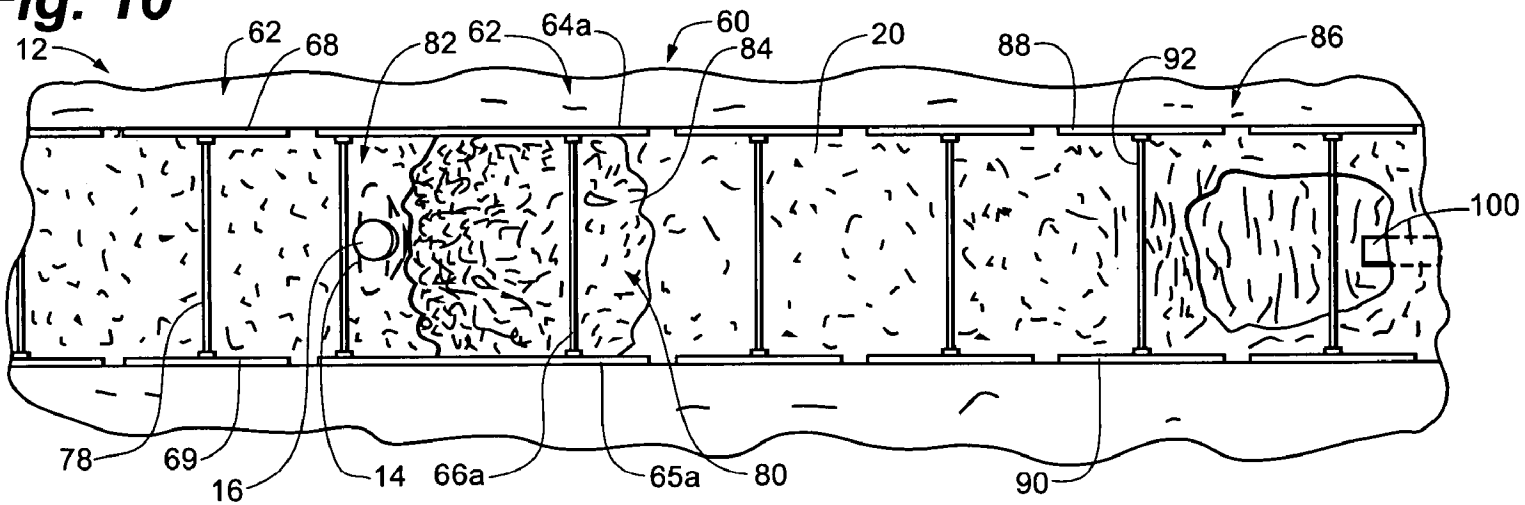
FIG. 10 is a plan view of the engulfment site of FIG. 9.

Shoring equipment 62 may include shoring members 64*a*, 64*b* and 64*c* as shown in FIGS. 6-10. Shoring members 64*a*-64*c* are preferably placed along a portion of the perimeter of dig sector 60 and extend downwardly to a depth sufficient to enable victim 14 to be extracted from engulfment site 12. Each shoring member is mated with another shoring member on an opposing side of dig sector 60. Shoring member 64*a* is mated with shoring member 65*a* as shown in FIG. 10, for example. A shoring support 66*a* extends between shoring member 64*a* and the shoring member mate 65*a*. Shoring support 66*a* is adjustable and provides rigid opposing support between shoring member 64*a* and its mated shoring member. Shoring support 66*b* provides opposing rigid support between shoring member 64*b* and shoring member mate to 64*b* in a similar manner. Shoring support 66*c* provides rigid support between shoring member 64*c* and mate to shoring member 64*c*. Preferably, shoring supports 66*a*-66*c* are pneumatically or hydraulically adjustable.

Excavation of victim 14 from engulfing material 20 proceeds in two phases: 1) the engulfment material reduction phase and 2) the engulfment material removal phase, which typically occur simultaneously. The engulfment material reduction phase is performed by a first operator 70 who loosens engulfing material 20 with reduction tool 22. The engulfment material removal phase is performed by a second operator 72 who removes the loosened engulfing material from dig sector 60 by positioning hose inlet 34 over the loosened material and vacuum conveying the material away from the site. For penetrating excavations, first operator 70 positions nozzle 28 of reduction tool 22 generally perpendicular to the ground. Otherwise, reduction tool 22 is typically moved along the excavation surface at about one to two feet per second depending on soil density and conditions.

Figure 5:
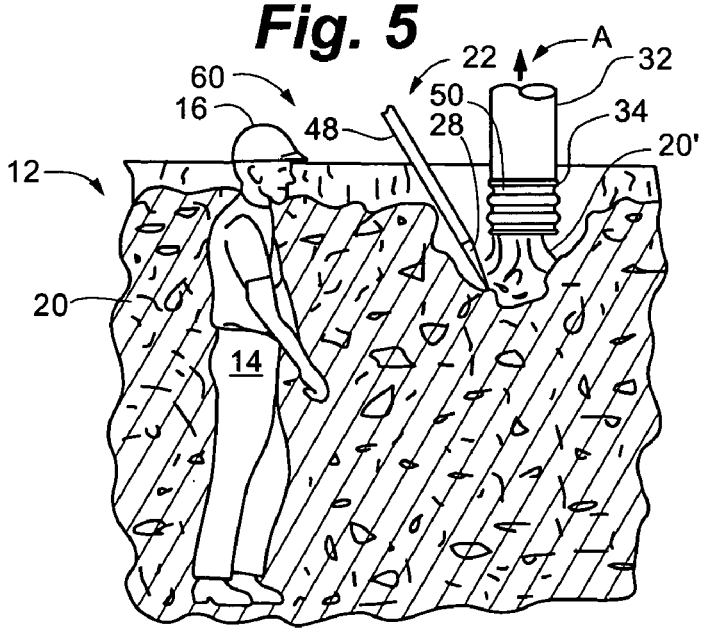
FIG. 5 is a fragmentary perspective view, partly in section, illustrating the rescue of a buried victim in accordance with the present invention.
Figure 6:
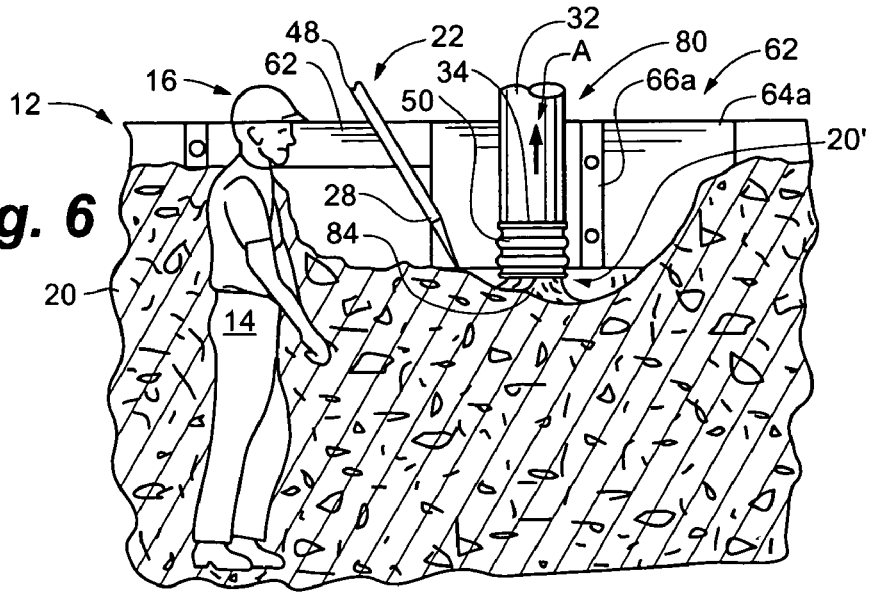
FIG. 6 is a fragmentary perspective view, partly in section, illustrating the operation of rescuing a buried victim in accordance with the invention.

Typically, second operator 72 maneuvers hose inlet 34 of vacuum hose 32 in a horizontal manner to excavate an area larger than the diameter of hose inlet 34 typically being careful not to immerse boot 50 or hose inlet 34 in engulfing material 20, as shown in FIGS. 1 and 5. Second operator 72 causes vacuum system 30 to convey the loosened material 20' through vacuum hose 32 in the direction of arrow A as shown in FIGS. 1 and 5-8 away from engulfment site 12 and should be careful not to outrun (i.e., excavate dangerously below) shoring equipment 62.

A third operator 74, who can be named a dig sector safety officer, is situated in a position to observe the operations of both first and second operators 70 and 72 as shown in FIG. 1. Operators 70, 72 and 74 are preferably safeguarded with suitable protective wear such as safety eyeglasses, protective earplugs, hard hat, durable boots and puncture resistant gloves. Preferably, operator 74 is located at an advantageous position above dig sector 60 with the ability to oversee and supervise entire dig sector 60. Third operator 74 coordinates the efforts of first and second operators 70 and 72, watches for signs of fatigue in operators 70 and 72, watches for any indication of instability and collapse of dig sector 60 and watches intently for any indication of victim 14 or a portion thereof during the rescue operations. Due to the inherent noise from the equipment used during the rescue operation, operators 70, 72 and 74 preferably communicate with hand and body signals. A preferred hand signal is a raised hand and arm above the head. This signal exhibited by any rescuer or operator is an indication to stop all operations and equipment and re-evaluate the rescue situation.

Third operator 74 also serves as the dig sector safety officer by maintaining and operating a switch or manual control 76 which reduces or stops the vacuum at hose inlet 34, which may operate by actuation of a relief valve in either hose 32 or vacuum source 36 to reduce, or alternatively completely cease, the vacuum force at vacuum hose inlet 34. Any suitable safety device or control to effect such vacuum reduction or cessation can be used. In an alternate embodiment, third operator 74 also maintains and operates a second switch, which when actuated, shuts off or blocks pressurized air from entering reduction tool 22. Operator 74 can thereby completely cease all operations at the slightest sign of trouble or instability as well as upon any sign of the victim. This reduces the risk of injury and/or entrapment of operators 70 and 72. Additional personnel can also be used as desired, including an overall safety officer (not shown), a compressor operator 71 and a vacuum truck operator 73.

Figure 7:
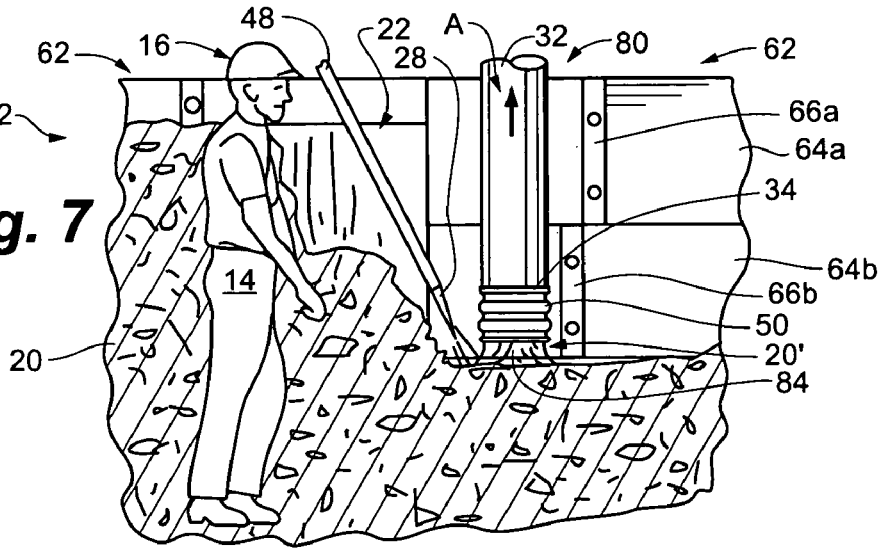
FIG. 7 is a fragmentary perspective view, partly in section, illustrating the continued operation of rescuing the buried victim.

Upon locating victim 14, any exposed areas of the victim can be protected with protective clothing or other material to the extent practical. For example, exposed head 16 of victim 14 is covered with protective wear before commencement of reduction and excavation operations. This prevents injury to victim 14 from flying debris resulting from the operation of reduction tool 22 and vacuum hose 32. Preferably, nozzle 28 of reduction tool 22 is typically pointed at an angle between about parallel to victim 14 and about 30° away from any portion of the victim's body as shown in FIGS. 8 and 7 respectively. First operator 70 is careful to position nozzle 28 typically no less than 3 inches from any portion of the victim. Reduction tool 22 is further operated so that nozzle 28 directs or blows loosened material away from victim 14. First and second operators then proceed to loosen and remove engulfing material away from the victim's face and chest areas as shown in FIGS. 5-8, and to continue removal of engulfing material. Safe extraction of victim 14 typically requires that rescue operations continue until victim 14 is substantially fully exposed and unburied or unengulfed, as a single cubic foot of dirt weighs as much as 145 pounds and even a small dig sector typically involves no less than 1.5 cubic yards of dirt weighing about 4000 pounds.

Preferably, dig sector 60 includes development of a primary or first sump area 80 as shown in FIGS. 1 and 5-8, for first rescue scenario, and in FIGS. 9 and 10 for second rescue scenario. Sump area 80 is preferably located adjacent to and horizontally in front of the face and chest of victim 14. The primary sump area, in this case primary sump area 80 is the primary area designated by the rescuers at which excavation and removal of engulfing material primarily occurs in order to effect the rescue or removal of the victim, in this case victim 14. It is understood, however, that the distance and position between victim 14 and sump area 80 is dependent upon the circumstances encountered at engulfment site 12. FIGS. 1 and 5-10 for example, illustrate trench rescue scenarios wherein the location of victim 14 is known. One skilled in the art will realize that it is not always possible to create a sump area next to the face and chest of the victim. Regardless of the orientation of the victim to the sump area, creating a sump area adds beneficial safety features to the rescue operations. A victim area 82 of dig sector 60 is stabilized with shoring members 68 and 69 and shoring support 78. Sump area 80 of dig sector 60 is shored with shoring members 64*a*-64*c* and 65*a* and shoring supports 66*a*-66*c* as previously described. First operator 70 loosens engulfing material 20 proximate the head and chest of victim 14 and directs loosened engulfing material 84 into sump area 80. Second operator 72 then positions hose inlet 34 over loosened engulfing material 84 and removes it from sump area 80. The development of sump area 80 is illustrated in FIGS. 1 and 5-8, for example, as engulfing material 20 is progressively removed in the rescue of victim 14. In FIGS. 1 and 5, sump area 80 is in the initial stages of development and continues to progress in FIG. 6, where shoring 66*a* and 64*a* has been added. Development of sump area 80 continues in FIG. 7 and pressure on victim's 14 chest is lessened by removal of engulfing material 20 in the development of sump area 80, with additional shoring 66*b* and 64*b* having been added. Sump area 80 is essentially completed in FIG. 8, with additional shoring 66*c* and 64*c* having been added and only a relatively small amount of engulfing material 20 remains to be removed in order to free victim 14. The remaining engulfing material can be removed by hand or with reduction tool 22, for example, in order to free victim 14.

The safety benefits of establishing a sump area in the dig sector are substantial. Maneuvering vacuum hose 32 in sump area 80 reduces the risk of injuring victim 14 with either hose inlet 34 or the suction forces emanating from hose inlet 34. Shoring sump area 80 provides additional stability to dig sector 60.

FIGS. 9 and 10 illustrate a second engulfment site where like reference numerals represent like or similar elements as previously described. FIGS. 9 and 10 illustrate a situation where engulfment site 12 is wet, such as from rain, partially submerged or encompasses a water source such as a sewer or water pipe 100, for example. In such situations, it is preferred to establish a second sump area in this case second sump area 86 that is positioned a distance from sump area 80 and away from victim 14. Second sump area 86 is located a sufficient distance from victim 14 as shown in FIGS. 9-10 so that it does not increase the risk of further cave-in adjacent victim 14. It is understood, however, that the location of second sump area 86 will be dictated by the circumstances of engulfment site 12. Further preferred is stabilizing second sump area 86 with shoring member 88, mated shoring member 90 and shoring support 92. Second sump area 86 serves as an accumulation area for a flowable material 94 which seeps into or out of engulfment site 12. Flowable material 94 may be a flowable solid, liquid or mixtures thereof including non-limiting examples such as soil, water, rain, mud, gravel, grain, fertilizer or sewage. Flowable material 94 may also include water discharged from a hydro-reduction tool used in the rescue operation. A second vacuum system having a hose 96 having an inlet 96' may be used to remove flowable material 94 in the direction of arrow B of FIG. 9 through second vacuum hose 96 from second sump area 86. Typically, inlet 96' will be positioned slightly above the material to be removed. Alternatively, second operator 72 may move vacuum hose 32 into second sump area 86 to remove flowable material 94 therefrom. Provision of second sump area 86 assists in further stabilizing dig sector 60 as the seepage of flowable material 94 may promote further collapse of engulfment area 12.

In an alternate embodiment of the present invention, an emergency rescue kit 98 is provided including reduction system 21, vacuum system 30 and shoring equipment 62 maintained together on a single transportable wheeled carrier such as a trailer, for example. Alternatively, kit 98 includes vacuum truck 37 adapted to transport reduction system 21 and shoring equipment 62. Kit 98 further provides at least 40 feet of compressed air line 26 and at least 40 feet of vacuum line 38. This enables kit 98 to deploy a safe distance from engulfment site 12 and avoid imparting additional load and/or vibrations to the area surrounding engulfment site 12. Preferably kit 98 is deployed no closer than about 30 feet from engulfment site 12

While the preferred embodiment of the invention has been described in detail herein, it will be appreciated by those skilled in the art that various modifications and alternatives to the embodiment could be developed in light of the overall teachings of the disclosure. Accordingly, the particular arrangements are illustrative only and are not limiting as to the scope of the invention, which is to be given the full breadth of the appended claims and any and all equivalents thereof.

What is claimed is:

1. A device for rescuing a person trapped in engulfing material comprising in combination:

a vacuum hose and a hose inlet and the hose inlet positionable at desired locations over the engulfing material;

a vacuum source in communication with the vacuum hose and hose inlet and of a sufficient airflow volume to be suitable to remove and vacuum convey engulfing material from an engulfing site when the vacuum hose inlet is positioned a distance above the engulfing material to be removed;

a reduction tool suitable for directing a stream of compressed air onto areas of engulfing material independent of the location of the vacuum hose inlet;

a safety device for at least substantially reducing the vacuum force at the vacuum hose inlet; and a shoring device.

2. The device of claim 1 wherein the safety device is manually actuable.

3. The device of claim 2 wherein the vacuum inlet further comprises a flexible boot.

4. The device of claim 2 further comprising a pressurized air source in communication with the soil reduction tool, the pressurized air source and the vacuum source being contained on a single movable wheeled device.

5. The device of claim 4 further comprising an air line extending from the pressurized air source to the air reduction tool and a vacuum line extending from the vacuum source to the vacuum hose inlet head, the lengths of said air line and the vacuum line being sufficient length so that when the device is used to rescue a victim from an engulfment site, the vehicle can be located at least thirty feet from the engulfment site.

6. The device of claim 2 wherein the reduction tool is unattached to the vacuum hose inlet head.

7. An emergency rescue kit for rescuing a person trapped in engulfing material at an engulfment site comprising:

a vacuum hose and a hose inlet and the hose inlet positionable at desired locations over the engulfing material;

a vacuum source in communication with the vacuum hose and hose inlet and of a sufficient airflow volume to be suitable to remove and vacuum convey engulfing material from an engulfing site when the vacuum hose inlet is positioned a distance above the engulfing material to be removed;

a reduction tool suitable for directing a stream of compressed air onto areas of engulfing material independent of the location of the vacuum hose inlet;

a safety device for at least substantially reducing the vacuum force at the vacuum hose inlet;

an air compressor for supplying compressed air at a suitable pressure and rate to the reduction tool to permit loosening of engulfing material;

at least forty feet of a compressed air line for extending from the air compressor to the reduction tool and at least forty feet of vacuum line for extending between the vacuum source and vacuum head for use in a rescue operation; and a shoring device.

8. The kit of claim 7 wherein the shoring device further comprises a shoring support selected from the group consisting of pneumatic and hydraulic shoring supports.

* * * * *